US012017324B2

(12) United States Patent
Zurbruegg

(10) Patent No.: US 12,017,324 B2
(45) Date of Patent: Jun. 25, 2024

(54) QUICK CLAMPING DEVICE FOR A PORTABLE MACHINE TOOL, IN PARTICULAR AN ANGLE GRINDER, COMPRISING AT LEAST ONE OUTPUT SHAFT THAT CAN BE ROTATABLY DRIVEN

(71) Applicant: Robert Bosch GmbH, Stuttgart (DE)

(72) Inventor: Andreas Zurbruegg, Lohn-Ammansegg (CH)

(73) Assignee: Robert Bosch GmbH, Stuttgart (DE)

( * ) Notice: Subject to any disclaimer, the term of this patent is extended or adjusted under 35 U.S.C. 154(b) by 1420 days.

(21) Appl. No.: 16/341,295

(22) PCT Filed: Oct. 4, 2017

(86) PCT No.: PCT/EP2017/075114
§ 371 (c)(1),
(2) Date: Apr. 11, 2019

(87) PCT Pub. No.: WO2018/072997
PCT Pub. Date: Apr. 26, 2018

(65) Prior Publication Data

US 2021/0276146 A1 Sep. 9, 2021

(30) Foreign Application Priority Data

Oct. 18, 2016 (DE) ..... 10 2016 220 367.3

(51) Int. Cl.
*B24B 45/00* (2006.01)
*B24B 23/02* (2006.01)

(52) U.S. Cl.
CPC ..... *B24B 45/006* (2013.01); *B24B 23/028* (2013.01)

(58) Field of Classification Search
CPC ..... B24B 23/022; B24B 23/028; B24B 23/04; B24B 45/006
See application file for complete search history.

(56) References Cited

U.S. PATENT DOCUMENTS 2,800,751 A 7/1957 Brucker
2002/0028644 A1* 3/2002 Rudolf ..... B24B 45/006 451/344

(Continued)

FOREIGN PATENT DOCUMENTS

CN 105473282 A 4/2016
CN 105817979 A 8/2016

(Continued)

OTHER PUBLICATIONS

International Search Report corresponding to PCT Application No. PCT/EP2017/075114, dated Jan. 9, 2018 (German and English language document) (5 pages).

*Primary Examiner* — Daniel Jeremy Leeds
(74) *Attorney, Agent, or Firm* — Maginot, Moore & Beck LLP

(57) ABSTRACT

A quick clamping device for a portable machine tool, in particular an angle grinder, includes at least one output shaft, at least one clamping unit, at least one operating unit, and at least one securing unit. The clamping unit, for the purpose of fixing an insert bit to the output shaft without using tools, includes at least one clamping element for applying a clamping force to the bit in a clamping position. The operating unit moves the clamping element into the clamping position and/or into a release position in which the insert bit can be removed from the clamping unit and/or the output shaft. The securing unit is designed to prevent movement of the clamping element from the clamping position into the release position at least under the action of a force decoupled from the operating unit and acting on the clamping element in the direction of the release position.

17 Claims, 2 Drawing Sheets

(56) References Cited

U.S. PATENT DOCUMENTS

| | | | | |
|---|---|---|---|---|
| 2015/0042052 | A1* | 2/2015 | Furusawa | B24B 23/04 279/141 |
| 2015/0108725 | A1 | 4/2015 | Luescher et al. | |

FOREIGN PATENT DOCUMENTS

| | | | |
|---|---|---|---|
| DE | 100 17 458 | A1 | 10/2001 |
| DE | 20 2013 006 901 | U1 | 12/2014 |
| EP | 1 790 434 | A1 | 5/2007 |
| EP | 2 896 492 | A1 | 7/2015 |
| GB | 2 283 191 | A | 5/1995 |
| JP | S60-143626 | U | 9/1985 |
| JP | 2013-158879 | A | 8/2013 |
| JP | 2016-529119 | A | 9/2016 |
| RU | 2008179 | C1 | 2/1994 |
| RU | 2595791 | C2 | 3/2015 |

* cited by examiner

QUICK CLAMPING DEVICE FOR A PORTABLE MACHINE TOOL, IN PARTICULAR AN ANGLE GRINDER, COMPRISING AT LEAST ONE OUTPUT SHAFT THAT CAN BE ROTATABLY DRIVEN

This application is a 35 U.S.C. § 371 National Stage Application of PCT/EP2017/075114, filed on Oct. 4, 2017, which claims the benefit of priority to Serial No. DE 10 2016 220 367.3, filed on Oct. 18, 2016 in Germany, the disclosures of which are incorporated herein by reference in their entirety.

BACKGROUND

DE 100 17 458 A1 has already disclosed a quick clamping device for a portable power tool, in particular angle grinder, which has at least one output shaft which can be driven in rotation, having at least one clamping unit which, for tool-free fixing of an insert tool unit to the output shaft, has at least one movably mounted clamping element for exertion of a clamping force on the insert tool unit in a clamping position of the clamping element, and having at least one operator control unit for moving the clamping element into the clamping position and/or into a release position of the clamping element, in which the insert tool unit can be removed from the clamping unit and/or from the output shaft.

SUMMARY

The disclosure proceeds from a quick clamping device for a portable power tool, in particular angle grinder, which has at least one output shaft which can be driven in rotation, having at least one clamping unit which, for tool-free fixing of an insert tool unit to the output shaft, has at least one movably mounted clamping element for exertion of a clamping force on the insert tool unit in a clamping position of the clamping element, and having at least one operator control unit for moving the clamping element into the clamping position and/or into a release position of the clamping element, in which the insert tool unit can be removed from the clamping unit and/or from the output shaft.

It is proposed that the quick clamping device comprises at least one securing unit, in particular a self-locking unit and/or a detent unit, which is provided for preventing a movement of the clamping element from the clamping position into the release position of the clamping element, in particular aside from tolerance-induced and/or play-induced movements of the clamping element, at least in the event of the clamping element being acted on by a force which is decoupled from the operator control unit and which acts in the direction of the release position of the clamping element. "Provided" is to be understood in particular to mean specially programmed, configured and/or equipped. The statement that an element and/or a unit is provided for a particular function is to be understood in particular to mean that the element and/or the unit carry/carries out and/or perform/performs said particular function in at least one state of use and/or operation. "Movably mounted" is to be understood in particular to mean a mounting of an element and/or of a unit, wherein the element and/or the unit have/has a movement capability, in particular decoupled from an elastic deformation of the element and/or of the unit, along a movement axis of more than 5 mm, preferably of more than 10 mm and particular preferably of more than 50 mm and/or about a movement axis along an angle range of more than 1°, preferably of more than 5° and particularly preferably of more than 15°. The securing unit, in particular the self-locking unit and/or the detent unit, is preferably provided for substantially securing the clamping element against a movement into the release position of the clamping element at least in the event of the clamping element being subjected to a force which is decoupled from the operator control unit and which acts in the direction of the release position of the clamping element. The expression "for substantially securing against a movement" is to be understood in particular to mean securing of an element, in particular in one position of the element, against a movement, wherein a tolerance-induced and/or play-induced movement of the element may occur in the secured position of the element. Preferably, in the secured position of the clamping element, a positively locking connection between the clamping element and the insert tool unit is ensured, in particular in order to prevent an inadvertent release of the insert tool unit from the clamping unit. The clamping element can preferably be secured in the clamping position, so as to be prevented from moving into the release position of the clamping element, by the securing unit by means of a positive lockingly and/or non-positively locking connection in the clamping position.

The clamping element is preferably movable by means of the operator control unit into the clamping position and/or into the release position by means of a mechanical connection between at least one operator control element of the operator control unit and the clamping element. The operator control element is preferably designed as an operator control lever, in particular as a pivotably mounted operator control lever. It is however also conceivable that, by means of an operator control element of the operator control unit, an electrical signal can be generated by means of which an actuator can be activated, which actuator is provided for moving the clamping element into the clamping position and/or into the release position. The operator control unit may be designed as a mechanical, an electrical and/or an electronic operator control unit, which is provided for moving the clamping element into the clamping position and/or into the release position as a result of an operator control command from an operator and/or as a result of an operator control force imparted by an operator.

The clamping element is preferably arranged at least partially in the output shaft. It is preferable for the output shaft to at least partially, in particular completely, surround the clamping element along a circumferential direction running around an axis of rotation of the output shaft. The clamping element is preferably connected rotationally conjointly to the output shaft. The clamping element is preferably mounted so as to be pivotable about a pivot axis of the clamping element. The pivot axis of the clamping element preferably runs transversely, in particular at least substantially perpendicularly, with respect to the axis of rotation of the output shaft. The pivot axis of the clamping element preferably runs at least substantially perpendicular to a clamping axis of the clamping unit. Here, a "clamping axis" is to be understood in particular to mean an axis of the clamping unit along which an axial securing force of the clamping unit can be exerted on the insert tool unit in order to fix the insert tool unit on the output shaft and/or along which a transmission element of the clamping unit is mounted so as to be movable for a movement of the clamping element. "At least substantially perpendicular" is to be understood in particular to mean an orientation of a direction relative to a reference direction, wherein the direction and the reference direction, viewed in particular in one plane, enclose an angle of 90°, and the angle has a maximum deviation of in particular less than 8°, advantageously less than 5° and particularly advantageously less than 2°. The clamping element is preferably formed as a clamping jaw. The clamping element is preferably provided for securing the insert tool unit axially on the output shaft. Preferably, the clamping element, at least in the clamping position, engages at least partially into the insert tool unit, in particular into a fixing recess of the insert tool unit. Preferably, at least in a state in which the insert tool unit is fixed by means of the clamping unit, the clamping element engages behind a clamping projection of the insert tool unit. The securing unit is preferably at least provided for at least substantially preventing a pivoting movement of the clamping element proceeding from the clamping position into the release position of the clamping element, in particular aside from a tolerance-induced and/or play-induced pivoting movement, so as to prevent a pivoting movement of the clamping element into the release position. The securing unit may be designed as a magnetic securing unit, as a mechanical securing unit, as an electronic securing unit or the like. In the case of the securing unit being designed as a magnetic securing unit, it is conceivable for the securing unit to comprise at least one magnet element which secures the clamping element in the clamping position by means of the action of a magnetic force. In the case of the securing unit being designed as a mechanical securing unit, it is conceivable for the securing unit to comprise at least one mechanical securing element which secures the clamping element in the clamping position by means of a positively locking and/or non-positively locking connection. In the case of the securing unit being designed as an electronic securing unit, it is conceivable for the securing unit to comprise at least one electronic element which secures the clamping element in the clamping position and/or which monitors a position of the clamping element and, when the clamping position is reached, activates an actuator which secures the clamping element in the clamping position. Further embodiments of the securing unit that appear expedient to a person skilled in the art are likewise conceivable.

The clamping unit preferably comprises at least two movably, in particular pivotably, mounted clamping elements. It is however also conceivable for the clamping unit to comprise a number of clamping elements other than two. Preferably, the at least two clamping elements have an at least substantially analogous design. Preferably, the at least two clamping elements of the clamping unit are mounted so as to be movable relative to one another, in particular pivotable relative to one another. In particular, the at least two clamping elements are movable by means of the operator control unit into a clamping position of the clamping elements and/or into a release position of the clamping elements. Preferably, the at least two clamping elements are movable jointly, in particular movable jointly into the clamping position and/or into the release position, by means of the operator control unit. It is however also conceivable for the at least two clamping elements to be movable independently of one another into the clamping position and/or into the release position by means of the operator control unit.

By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool.

It is furthermore proposed that the securing unit has at least one movably mounted positive locking and/or non-positive locking element which, at least in the clamping position of the clamping element, engages at least partially into the clamping element and/or into the transmission element, which interacts with the clamping element, of the clamping unit, in order to secure the clamping element against a movement into the release position of the clamping element. The positive locking element and/or non-positive locking element may be designed as an in particular spring-loaded detent element which, at least in the clamping position, engages into the clamping element and/or the transmission element, or the positive locking and/or non-positive locking element may be designed as a slotted-guide engagement element, in particular as a clamping bolt, which engages into a motion slotted guide of the clamping unit, which is arranged in particular on the clamping element. Further embodiments of the positive locking and/or non-positive locking element that appear expedient to a person skilled in the art are likewise conceivable. The transmission element is preferably designed as a clamping fork. The transmission element is preferably mounted in movable fashion, in particular translationally movable fashion, in the output shaft. The clamping unit preferably has at least one spring element which acts on the transmission element with a spring force in the direction of the operator control unit, in particular in the direction of the clamping position of the clamping element. The spring element is preferably arranged in the output shaft. The transmission element is preferably connected rotationally conjointly to the output shaft. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position.

It is also proposed that the securing element has at least one movably mounted positive locking and/or non-positive locking element which, at least in the clamping position of the clamping element, bears against the clamping element such that a main securing force can be exerted on the clamping element along a direction running at least substantially parallel or at least substantially perpendicular to a clamping axis of the clamping unit, which main securing force counteracts a movement of the clamping element into the release position, in particular at least in the event of the clamping element being subjected to a force which is decoupled from the operator control unit and which acts in the direction of the release position of the clamping element. The main securing force can preferably be exerted on the clamping element by means of a positively locking and/or non-positive locking connection between the positive locking and/or non-positive locking element and the clamping element and/or the transmission element. In the case of the positive locking and/or non-positive locking element being designed as a slotted-guide engagement element, a main direction of action of the main securing force is preferably oriented at least substantially perpendicular to the clamping axis. In the case of the positive locking and/or non-positive locking element being designed as a detent element, a main direction of action of the main securing force is preferably oriented at least substantially parallel to the clamping axis and in the direction of the clamping position. A "main securing force" is to be understood in particular to mean a force component of a reaction force with a greatest magnitude of two force components of the reaction force and/or a force acting along a single direction. The main securing force preferably acts such that no force components or only small force components act along the clamping axis on the transmission element. It can advantageously be achieved that the slotted-guide engagement element cannot move into a release contour of the slotted-guide element, in particular of the slotted-guide track. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position.

It is furthermore proposed that the securing unit is formed at least partially integrally with the clamping unit, wherein the securing unit has at least one self-locking contour arranged on the clamping element. The statement that "a unit is formed at least partially integrally with a further unit" is to be understood in particular to mean that the unit and the further unit have at least one common component. The self-locking contour is preferably formed integrally with the clamping element. "Integrally" is to be understood in particular to mean at least cohesively connected, for example by means of a welding process, an adhesive bonding process, a molding-on process and/or some other process that appears expedient to a person skilled in the art, and/or advantageously understood to mean formed in one piece, for example by production by casting and/or by production in a single-component or multi-component injection molding process, and advantageously from a single blank. It is however also conceivable for the self-locking contour to be formed separately from the clamping element and to be fixed to the clamping element by means of a positively locking and/or non-positive locking connection. The self-locking contour is preferably part of a slotted-guide element of the clamping unit, in particular of a slotted-guide track which is arranged on the clamping element. The slotted-guide element, in particular the slotted-guide track, is preferably provided for a movement of the clamping element into the clamping position and/or into the release position, in particular by means of an interaction of the positive locking and/or non-positive locking element which engages into the slotted-guide element, in particular into the slotted-guide track. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position. It is advantageously possible to realize a particularly compact design of the clamping unit and/or of the securing unit.

It is furthermore proposed that the self-locking contour is, in the clamping position of the clamping element, oriented such that, in the event of the clamping element being subjected to a force which is decoupled from the operator control unit and which acts in the direction of the release position of the clamping element, a main securing force, which runs at least substantially perpendicular to a clamping axis of the clamping unit, can be exerted on the clamping element at least by means of the self-locking contour. The self-locking contour is preferably mounted so as to be movable, in particular pivotable, together with the clamping element. Preferably, in the clamping position of the clamping element, in the event of the clamping element being subjected to a force which is decoupled from the operator control unit and which acts in the direction of the release position of the clamping element, a main securing force which runs at least substantially perpendicular to a clamping axis of the clamping unit can be exerted on the clamping element by means of an interaction of the positive locking and/or non-positive locking element and the self-locking contour. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position. It is advantageously possible for a securing force to be generated which at least substantially prevents an inadvertent movement of the clamping element from the clamping position into the release position of the clamping element.

It is also proposed that the self-locking contour, in particular a contact surface of the self-locking contour for contact with the positive locking and/or non-positive locking element, encloses an angle of less than 40° with a clamping axis of the clamping unit, in particular in a plane which runs at least substantially parallel to the clamping axis and at least substantially perpendicular to the pivot axis of the clamping element. Here, "at least substantially parallel" is to be understood to mean an orientation of a direction relative to a reference direction, in particular in a plane, wherein the direction has a deviation relative to the reference direction of in particular less than 8°, advantageously less than 5° and particularly advantageously less than 2°. The self-locking contour preferably encloses an angle of in particular less than 30°, preferably less than 20° and particular preferably less than 10° with the clamping axis of the clamping unit at least in the clamping position of the clamping element. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position. It can be made possible in a simple manner in terms of construction that, at least in the clamping position and in the event of the clamping element being subjected to a force which is decoupled from the operator control unit and which acts in the direction of the release position of the clamping element, a securing force running at least substantially perpendicular to the clamping axis of the clamping unit can be exerted on the clamping element, in particular by means of an interaction of the self-locking contour and the positive-locking and/or non-positive locking element, which bears against the self-locking contour.

It is also proposed that the self-locking contour has at least one contact surface which, in the clamping position of the clamping element, runs at least substantially parallel to a clamping axis of the clamping unit. The contact surface of the self-locking contour preferably bears against the positive locking and/or non-positive locking element at least in the clamping position of the clamping element. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position. It can be made possible in a simple manner in terms of construction that, at least in the clamping position and in the event of the clamping element being subjected to a force which is decoupled from the operator control unit and which acts in the direction of the release position of the clamping element, a securing force running at least substantially perpendicular to the clamping axis of the clamping unit can be exerted on the clamping element, in particular by means of an interaction of the self-locking contour and the positive-locking and/or non-positive locking element, which bears against the self-locking contour.

It is furthermore proposed that the self-locking contour is arranged in a transition region between a clamping contour and a release contour of a slotted-guide element of the clamping unit. The clamping contour, the release contour and the self-locking contour are preferably formed integrally with the slotted-guide element, in particular the slotted-guide track. The clamping contour, the release contour and the self-locking contour preferably form a guide track of the slotted-guide element, which are provided for a movement of the clamping element into the clamping position and/or the release position, in particular by means of an interaction with the positive locking and/or non-positive locking element, in particular the positive locking and/or non-positive locking element designed as a clamping bolt. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position. It is advantageously possible to realize a compact design of the securing unit. An integration of the securing unit into the clamping unit can be realized in a simple manner in terms of construction.

It is also proposed that the securing unit comprises at least one spring element which acts on at least one movably mounted positive locking and/or non-positive locking element of the securing unit with a spring force in the direction of the clamping element. The positive locking and/or non-positive locking element is preferably designed as a detent element which is provided for engaging into the clamping element and/or into the transmission element at least in the clamping position. The spring element is preferably designed as a compression spring, in particular as a helical compression spring. It is however also conceivable for the spring element to be designed as a tension spring, as a torsion spring or as some other spring element that appears expedient to a person skilled in the art. The spring element is preferably supported with one end on the positive locking and/or non-positive locking element, and the spring element is supported by means of a further end on the output shaft, in particular on an inner side of the output shaft, or on an intermediate element arranged between the clamping element and the output shaft. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position. It is advantageously possible to realize an automatic movement of the positive locking and/or non-positive locking into a securing position.

It is also proposed that the positive locking and/or non-positive locking element is movable counter to a spring force of the spring element by means of the operator control unit. The positive locking and/or non-positive locking element, in particular in the case of an embodiment of a detent element, is preferably movable counter to a spring force of the spring element, in particular in order to enable a movement capability of the clamping element, in the event of a transfer of the clamping element from the clamping position into the release position. Preferably, the positive locking and/or non-positive locking element, in particular the detent element, is mounted so as to be movable in translational fashion, in particular along a movement axis running at least substantially perpendicular to the clamping axis. It is however also conceivable in an alternative embodiment of the clamping unit for the positive locking and/or non-positive locking element, in particular the detent element, to be mounted so as to be pivotable. By means of the embodiment according to the disclosure of the quick clamping device, it is advantageously possible to realize a high level of operator safety. It is advantageously possible for an inadvertent transfer of the clamping element from the clamping position into the release position to be at least substantially prevented.

It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position.

It is furthermore proposed that the clamping element comprises at least one securing recess into which the positive locking and/or non-positive locking element, in particular the detent element, at least partially engages in the clamping position of the clamping element. The positive locking and/or non-positive locking element, in particular the detent element, is preferably at least partially movable into the securing recess of the clamping element by means of the spring force of the spring element in the clamping position. It is however also conceivable for the securing unit to have an electric, magnetic or hydraulic actuator which is provided for moving the positive locking and/or non-positive locking element, in particular the detent element, at least partially into the securing recess of the clamping element in the clamping position of the clamping element. Further technical possibilities that appear expedient to a person skilled in the art for a movement of the positive locking and/or non-positive locking element, in particular of the detent element, into the securing recess are likewise conceivable. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position.

It is also proposed that the securing unit, in particular in an alternative embodiment of the securing unit, has at least one positive locking and/or non-positive locking element which is movable by means of a centrifugal force into a securing position of the positive locking and/or non-positive locking element, in which securing position the clamping element is substantially secured against a movement from the clamping position into the release position of the clamping element. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position. It can advantageously be ensured that, in particular during operation of the portable power tool, an inadvertent release of the insert tool unit from the clamping unit and/or from the output shaft can be prevented.

It is also proposed that the securing unit has at least one output element which is provided for outputting at least a functional state of the securing unit to an operator. The output element may be designed as a mechanical element, as an electronic element or as an electric element. The output element is preferably provided for outputting a functional state of the securing unit to an operator by haptic, acoustic and/or optical means. The functional state of the securing unit preferably describes a state of the securing unit such as for example a securing of the clamping element, a released state, in which the clamping element is not secured, a defect of the securing unit or other states of the securing unit that appear expedient to a person skilled in the art. The output element may be designed as a display, as a single light source, such as for example an LED, as a mechanically movable display element, as a loudspeaker or the like. By means of the embodiment according to the disclosure of the quick clamping device, it is advantageously possible to realize a high level of operator safety. It is advantageously possible for an inadvertent transfer of the clamping element from the clamping position into the release position to be at least substantially prevented. It is advantageously possible for an inadvertent release of the insert tool unit from the clamping unit to be counteracted. It is advantageously possible to realize reliable and secure fixing of the insert tool unit to the clamping unit and/or to the output shaft of the portable power tool. It is advantageously possible in a simple manner in terms of construction to realize reliable securing of the clamping element against inadvertent movement into the release position. It can advantageously be signaled to an operator whether the clamping element has been reliably secured by means of the securing unit or whether a defect of the securing unit is present.

Also proposed is a portable power tool, in particular an angle grinder, having a quick clamping device according to the disclosure. Here, a "portable power tool" is to be understood in particular to mean a power tool for machining workpieces, which power tool can be transported by an operator without using a transport machine. The portable power tool has in particular a mass of less than 40 kg, preferably less than 10 kg and particularly preferably less than 5 kg. The portable power tool is particularly preferably designed as an angle grinder. It is however also conceivable for the portable power tool to be of some other design that appears expedient to a person skilled in the art, for example designed as a circular saw, as a grinder or the like. The portable power tool preferably comprises an output shaft that can be driven in rotation. The quick clamping device is preferably arranged on the output shaft. The quick clamping device is preferably arranged at least partially in the output shaft. The output shaft is preferably designed as a hollow shaft. In particular, the portable power tool forms a power tool system together with an insert tool unit that can be fixed by means of the quick clamping device to the output shaft. By means of the embodiment according to the disclosure of the quick clamping device, it is advantageously possible to realize a high level of operator safety. It can advantageously be ensured that an inadvertent transfer of the quick clamping device, in particular of the clamping element of the clamping unit of the quick clamping device, into a release position occurs. An inadvertent release of the insert tool unit from the quick clamping device can advantageously be prevented. A safe portable power tool can advantageously be realized.

Here, it is not the intention for the quick clamping device according to the disclosure and/or the portable power tool according to the disclosure to be restricted to the use and embodiment described above. In particular, the quick clamping device according to the disclosure and/or the portable power tool according to the disclosure may, in order to perform a function described herein, have a number of individual elements, components and units and method steps that deviates from a number stated herein. Furthermore, where value ranges are stated in this disclosure, it is also the intention for values lying within the stated limits to be disclosed and usable as desired.

BRIEF DESCRIPTION OF THE DRAWINGS

Further advantages will emerge from the following description of the drawing. The drawing illustrates exemplary embodiments of the disclosure. The drawing, the description and the claims contain numerous features in combination. A person skilled in the art will expediently also consider the features individually and combine to form meaningful further combinations.

In the drawing.

DETAILED DESCRIPTION

Figure 1:
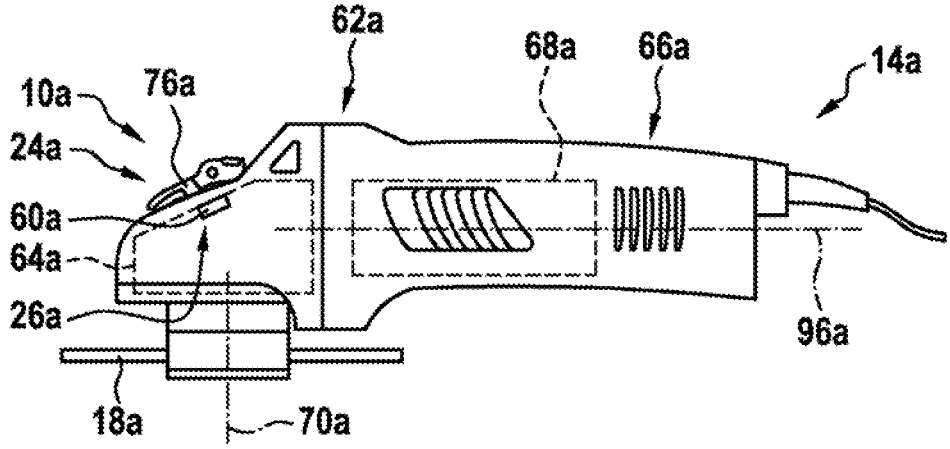
FIG. 1 shows a portable power tool according to the disclosure having a quick clamping device according to the disclosure in a schematic illustration.
Figure 2:
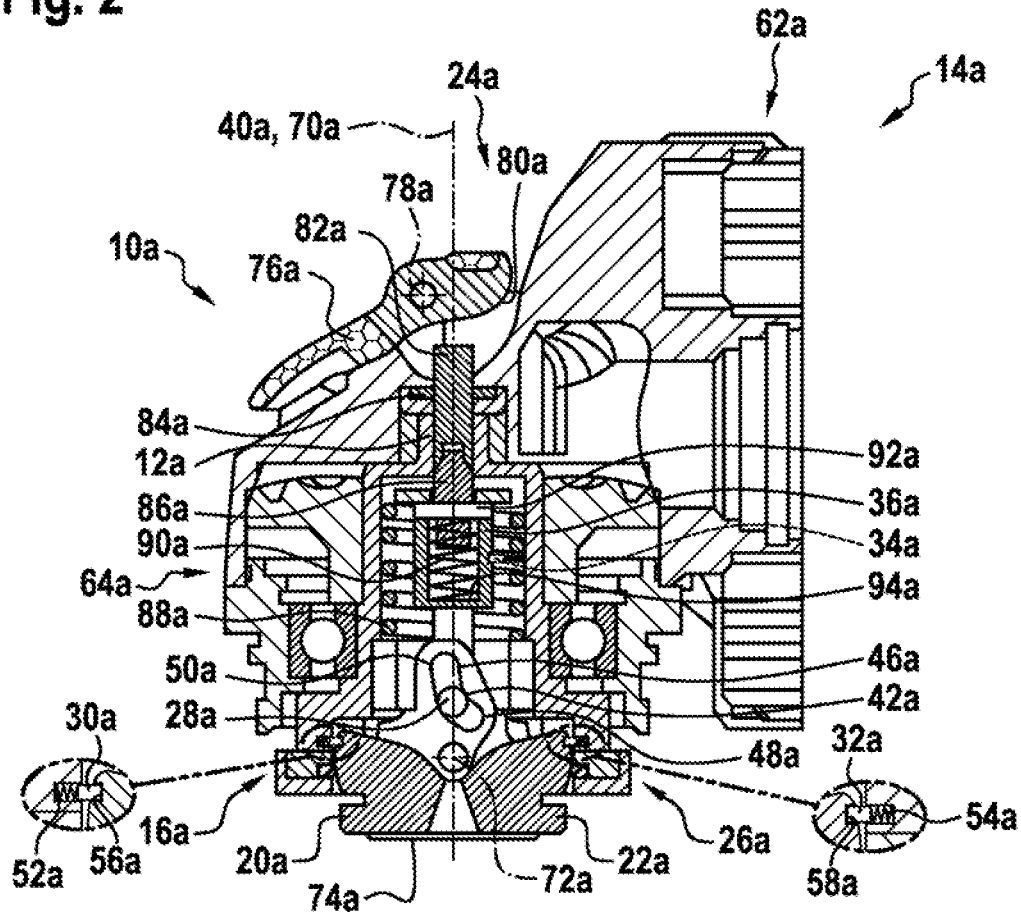
FIG. 2 shows a sectional view of the portable power tool according to the disclosure and of the quick clamping device according to the disclosure in a schematic illustration.

FIG. 1 shows a portable power tool 14*a* which is designed as an angle grinder and which has a quick clamping device 10*a*. It is however also conceivable for the portable power tool 14*a* to be of some other design that appears expedient to a person skilled in the art, for example designed as a circular saw, as a grinder or the like. The portable power tool 14*a* comprises a gearing housing 62*a* for accommodating and/or for the mounting of a gearing unit 64*a* of the portable power tool 14*a*. The gearing housing 62*a* is preferably formed from a metallic material. It is however also conceivable for the gearing housing 62*a* to be formed from some other material that appears expedient to a person skilled in the art, for example from plastic or the like. The gearing unit 64*a* is preferably designed as an angle gearing. The gearing unit 64*a* comprises in particular an output shaft 12*a* which can be driven in rotation and to which an insert tool unit 18*a* can be fixed, in particular by means of the quick clamping device 10*a*. The output shaft 12*a* is preferably designed as a hollow spindle, in which the quick clamping device 10*a* is at least partially arranged (FIG. 2). A protective cover unit (not illustrated in any more detail here) can be arranged, in a manner already known to a person skilled in the art, on the gearing housing 62*a*. An auxiliary handle (not illustrated in any more detail here) can be arranged, in a manner already known to a person skilled in the art, on the gearing housing 62*a*. The portable power tool 14*a* comprises a motor housing 66*a* for accommodating and/or for the mounting of a drive unit 68*a* of the portable power tool 14*a*. The drive unit 68*a* is preferably provided, in a manner already known to a person skilled in the art, for driving the output shaft 12*a* in rotation about an axis of rotation 70*a* of the output shaft 12*a* by interaction with the gearing unit 64*a*. The axis of rotation 70*a* of the output shaft 12*a* runs at least substantially perpendicular to a drive axis 96*a* of the drive unit 68*a*. The drive unit 68*a* is preferably designed as an electric motor unit. It is however also conceivable for the drive unit 68*a* to be of some other design that appears expedient to a person skilled in the art, for example designed as a combustion-type drive unit, as a hybrid drive unit, as a pneumatic drive unit or the like.

FIG. 2 shows a sectional view of the portable power tool 14*a*, in particular in the region of the gearing housing 62*a*, and of the quick clamping device 10*a*. The quick clamping device 10*a* for the portable power tool 14*a*, which has at least the output shaft 12*a* that can be driven in rotation, comprises at least one clamping unit 16*a*, which, for tool-free fixing of the insert tool unit 18*a* to the output shaft 12*a*, has at least one movably mounted clamping element 20*a*, 22*a* for the action of a clamping force on the insert tool unit 18*a* in a clamping position of the clamping element 20*a*, 22*a*. Furthermore, the quick clamping device 10*a* comprises at least one operator control unit 24*a* for moving the clamping element 20*a*, 22*a* into the clamping position and/or into a release position of the clamping element 20*a*, 22*a*, in which the insert tool unit 18*a* is removable from the clamping unit 16*a* and/or from the output shaft 12*a*. The clamping unit 16*a* comprises at least two movably mounted clamping elements 20*a*, 22*a*. It is however also conceivable for the clamping unit 16*a* to comprise a number of clamping elements 20*a*, 22*a* other than two. The at least two clamping elements 20*a*, 22*a* have an at least substantially analogous design, such that features disclosed with regard to one of the clamping elements 20*a*, 22*a* are to be regarded as likewise disclosed for the further clamping element 20*a*, 22*a*. The at least two clamping elements 20*a*, 22*a* are pivotably mounted. A pivot axis 72*a* of the at least two clamping elements 20*a*, 22*a* runs at least substantially perpendicular to the axis of rotation 70*a* of the output shaft 12*a*. The at least two clamping elements 20*a*, 22*a* are provided for fixing the insert tool unit 18*a*, in a state in which it is arranged on the clamping unit 16*a* and/or the output shaft 12*a*, axially on the output shaft 12*a*, in particular in the clamping position of the at least two clamping elements 20*a*, 22*a*. The at least two clamping elements 20*a*, 22*a* are connected rotationally conjointly to the output shaft 12*a*. The at least two clamping elements 20*a*, 22*a* can be driven in rotation about the axis of rotation 70*a* together with the output shaft 12*a*.

The clamping unit 16*a* comprises, for a transmission of torque to the insert tool unit 18*a*, at least one rotary driving element 74*a*. In a state of the insert tool unit 18*a* in which it is arranged on the clamping unit 16*a* and/or the output shaft 12*a*, the rotary driving element 74*a* engages into a receiving recess (not illustrated in any more detail here) of the insert tool unit 18*a* and, for a transmission of torque, bears against at least one edge, which delimits the receiving recess, of the insert tool unit 18*a*. A transmission of torque between the output shaft 12*a* and the insert tool unit 18*a* arranged on the clamping unit 16*a* and/or the output shaft 12*a* is preferably realized, in a manner already known to a person skilled in the art, by means of a positive locking connection between the rotary driving element 74*a* and the insert tool unit 18*a*. The rotary driving element 74*a* is arranged rotationally conjointly on the output shaft 12*a*. The rotary driving element 74*a* can be driven in rotation about the axis of rotation 70*a* together with the output shaft 12*a*.

The operator control unit 24*a* is preferably provided for moving the clamping element 20*a*, 22*a*, in particular the at least two clamping elements 20*a*, 22*a*, at least into the release position, in which the insert tool unit 18*a* is removable from the clamping unit 16*a* and/or from the output shaft 12*a*. Alternatively or in addition, it is conceivable for the operator control unit 24*a* to be provided for moving the clamping element 20*a*, 22*a*, in particular the at least two clamping elements 20*a*, 22*a*, at least into the clamping position, in which the insert tool unit 18*a* is fixable by means of the clamping unit 16*a* to the output shaft 12*a*. The operator control unit 24*a* preferably comprises at least one operator control element 76*a*, which is actuatable by an operator. The operator control element 76*a* is designed as an operator control lever. The operator control element 76*a* comprises a movement axis 78*a*, in particular a pivot axis, which runs transversely, in particular at least substantially perpendicularly, with respect to the axis of rotation 70*a* of the output shaft 12*a*. The operator control element 76*a* is preferably mounted so as to be pivotable about the movement axis 78*a*, in particular pivot axis. The operator control element 76*a* is decoupled from a rotational movement of the output shaft 12*a*. The operator control element 76*a* comprises an eccentric portion 80*a* for an actuation of the actuating element 82*a* of the operator control unit 24*a*. The actuating element 82*a* is mounted so as to be movable in translational fashion along the axis of rotation 70*a*, in particular in the output shaft 12*a* and/or in the gearing housing 62*a*. The actuating element 82*a* is fixed in the gearing housing 62*a* so as to be prevented from rotating relative to the gearing housing 62*a*, in particular owing to at least one lateral flattened portion of the actuating element 82*a*, which permits an axial movement and prevents a rotational movement. In the region of the actuating element 82*a*, there is preferably arranged a seal element 84*a*, for example a rubber seal or the like, in particular for at least substantially preventing an ingress of dirt into the gearing housing 62*a* and/or into the clamping unit 16*a*.

The operator control unit 24*a* comprises at least one decoupling element 86*a* which can be placed in contact with the actuating element 82*a* or is in contact with the actuating element 82*a*. The decoupling element 86*a* is preferably mounted, in particular in the output shaft 12*a* or in a transmission element 36*a* of the clamping unit 16*a*, so as to be movable in translational fashion along the axis of rotation 70*a*. The decoupling element 86*a* comprises in particular a conical connection region which engages at least partially into a recess of the actuating element 82*a*. A friction action between the actuating element 82*a* and the decoupling element 86*a* is in particular dependent on a design of the conical connecting region and on a spring force of a decoupling spring element 90*a* of the operator control unit 24*a*. The decoupling spring element 90*a* is provided for acting on the decoupling element 86*a* with a spring force in the direction of the actuating element 82*a*. The decoupling spring element 90*a* is arranged in the transmission element 36*a* of the clamping unit 16*a*. The transmission element 36*a* is designed as a clamping fork. The transmission element 36*a* is connected rotationally conjointly to the output element 12*a*. The transmission element 36*a* is movable in translational fashion along a clamping axis 40*a* of the clamping unit 16*a*. The transmission element 36*a* is mounted movably in the output shaft 12*a*. The transmission element 36*a* can, at least by means of a clamping spring element 88*a* of the clamping unit 16*a*, be acted on with a spring force along the clamping axis 40*a*, in particular in the direction of the operator control unit 24*a*.

The operator control unit 24*a* has at least one connecting element 92*a* which is provided for connecting the decoupling element 86*a* and the transmission element 36*a* to one another in terms of movement, in particular at least in a state of the output shaft 12*a* at a low rotational speed or when the output shaft 12*a* is at a standstill. The connecting element 92*a* is designed as a bolt. The connecting element 92*a* is fixed to the decoupling element 86*a*. The connecting element 92*a* is movable together with the decoupling element 86*a*. The connecting element 92*a* extends into a guide slot (not illustrated in any more detail here) of the transmission element 36*a*. During a rotational movement of the output shaft 12*a*, the decoupling element 86*a* and the connecting element 92*a* are rotatable relative to the transmission element 36*a* owing to a braking action resulting from an actuation of the actuating element 82*a*, wherein the connecting element 92*a* is movable in the guide slot such that the decoupling element 86*a* is movable counter to a spring force of the decoupling spring element 90*a* into a guide recess 94*a* of the transmission element 36*a*. An actuation of the operator control element 76*a* during a rotational movement of the output shaft 12*a* can be converted into a movement of the actuating element 82*a* and of the decoupling element 86*a* relative to the transmission element 36*a*. A movement of the transmission element 36*a* resulting from an action of an operator control force by means of the operator control unit 24*a* for the purposes of transferring the clamping element 20*a*, 22*a*, in particular the clamping elements 20*a*, 22*a*, from the clamping position into the release position can be substantially prevented during a rotational movement of the output shaft 12*a*. When the output shaft 12*a* is at a low rotational speed or when the output shaft 12*a* is at a standstill, an axial force exerted by the actuating element 82*a* on the decoupling element 86*a* can be transmitted to the transmission element 36*a* by means of an interaction of the connecting element 92*a* and the guide slot. The transmission element 36*a* is movable by means of the operator control unit 24*a* counter to a spring force of the clamping spring element 88*a*. The transmission element 36*a* is provided for moving the clamping element 20*a*, 22*a*, in particular the clamping elements 20*a*, 22*a*, from the clamping position into the release position.

The clamping element 20*a*, 22*a*, in particular the clamping elements 20*a*, 22*a*, is/are mounted movably, in particular pivotably, on the output shaft 12*a*, in particular in the output shaft 12*a*. The pivot axis 72*a* of the clamping element 20*a*, 22*a*, in particular of the clamping elements 20*a*, 22*a*, runs preferably at least substantially perpendicular to the clamping axis 40*a* of the clamping unit 16*a*. The clamping element 20*a*, 22*a*, in particular the clamping elements 20*a*, 22*a*, has/have at least one slotted-guide element 50*a* which is provided for interacting with a slotted-guide engagement element. The slotted-guide engagement element is fixed to the transmission element 36*a*. Owing to an interaction of the slotted-guide engagement element and of the slotted-guide element 50*a*, the clamping element 20*a*, 22*a*, in particular the clamping elements 20*a*, 22*a*, is/are movable from the clamping position into the release position or from the release position into the clamping position. The clamping element 20*a*, 22*a*, in particular the clamping elements 20*a*, 22*a*, is/are in particular movable from the release position into the clamping position by means of an action of a spring force of the clamping spring element 88*a* on the transmission element 36*a*. The clamping element 20*a*, 22*a*, in particular the clamping elements 20*a*, 22*a*, is/are movable into the clamping position automatically, in particular after withdrawal of an action of a force exerted by an operator by means of the operator control unit 24*a*, owing to an action of a spring force of the clamping spring element 88*a*.

The quick clamping device 10*a* comprises at least one securing unit 26*a*, in particular a self-locking unit and/or a detent unit, which is provided for preventing a movement of the clamping element 20*a*, 22*a*, in particular of the clamping elements 20*a*, 22*a*, from the clamping position into the release position of the clamping element 20*a*, 22*a*, in particular of the clamping elements 20*a*, 22*a*, at least in the event of the clamping element 20*a*, 22*a*, in particular the clamping elements 20*a*, 22*a*, being acted on by a force which is decoupled from the operator control unit 24*a* and which acts in the direction of the release position of the clamping element 20*a*, 22*a*, in particular of the clamping elements 20*a*, 22*a*. The securing unit 26*a* has at least one movably mounted positive locking and/or non-positive locking element 28*a*, 30*a*, 32*a*, 34*a* which, at least in the clamping position of the clamping element 20*a*, 22*a*, in particular of the clamping elements 20*a*, 22*a*, engages at least partially into the clamping element 20*a*, 22*a*, in particular the clamping elements 20*a*, 22*a*, and/or into the transmission element 36*a*, which interacts with the clamping element 20*a*, 22*a*, in particular with the clamping elements 20*a*, 22*a*, of the clamping unit 16*a*, in order to secure the clamping element 20*a*, 22*a*, in particular the clamping elements 20*a*, 22*a*, against a movement into the release position of the clamping element 20*a*, 22*a*, in particular of the clamping elements 20*a*, 22*a*. The positive locking and/or non-positive locking element 28*a* is formed as the slotted-guide engagement element (cf. FIGS. 2 and 3). The positive locking and/or non-positive locking element 28*a* is designed as a bolt which is fixed to the transmission element 36*a*, in particular between two fork ends of the transmission element 36*a*. Alternatively or in addition, the securing unit 26*a* comprises at least one further positive locking and/or non-positive locking element 30*a*, 32*a*, which is designed as a detent element and which is provided for engaging into the clamping element 20*a*, 22*a*, in particular in the clamping position of the clamping element 20*a*, 22*a*. The securing unit 26*a* preferably alternatively or additionally comprises at least two further positive locking and/or non-positive locking elements 30*a*, 32*a* designed as detent elements, wherein in each case one engages into one of the clamping elements 20*a*, 22*a*, in particular in the clamping position of the clamping elements 20*a*, 22*a*. The further positive locking and/or non-positive locking elements 30*a*, 32*a* are designed as movably mounted detent elements. The further positive locking and/or non-positive locking elements 30*a*, 32*a* are movable, in particular movable in translational fashion, along a direction running at least substantially perpendicular to the axis of rotation 70*a* and/or to the clamping axis 40*a*. The axis of rotation 70*a* and the clamping axis 40*a* preferably run at least substantially parallel, in particular, axially, with respect to one another. The securing unit 26*a* preferably alternatively or additionally comprises an additional positive locking and/or non-positive locking element 34*a*, which is provided for engaging into the transmission element 36*a*, in particular in a clamping position of the clamping elements 20*a*, 22*a* and/or in an end position, moved by means of a spring force of the clamping spring element 88*a*, of the transmission element 36*a*. The additional positive locking and/or non-positive locking element 34*a* is designed as a movably mounted detent element. The additional positive locking and/or non-positive locking element 34*a* is mounted so as to be movable, in particular movable in translational fashion, along a direction running at least substantially perpendicular to the axis of rotation 70*a* and/or to the clamping axis 40*a*.

The securing unit 26*a* has at least the movably mounted positive locking and/or non-positive locking element 28*a*, 30*a*, 32*a*, in particular the positive locking and/or non-positive locking element 28*a* designed as a slotted-guide engagement element and/or the further positive locking and/or non-positive locking elements 28*a* designed as detent elements, which, at least in the clamping position of the clamping element 20*a*, 22*a*, in particular of the clamping elements 20*a*, 22*a*, bear(s) against the clamping element 20*a*, 22*a*, in particular against the clamping elements 20*a*, 22*a*, such that a main securing force 38*a* (cf. FIG. 3) can be exerted on the clamping element 20*a*, 22*a*, in particular the clamping elements 20*a*, 22*a*, along a direction running at least substantially parallel or at least substantially perpendicular to the clamping axis 40*a* of the clamping unit 16*a*, which main securing force counteracts a movement of the clamping element 20*a*, 22*a*, in particular of the clamping elements 20*a*, 22*a*, into the release position. The main securing force 38*a* preferably acts such that no force components or only small force components act along the clamping axis 40*a* on the transmission element 36*a*. It can advantageously be achieved that the slotted-guide engagement element cannot move into a release contour 48*a* of the slotted-guide element 50*a*, in particular of the slotted-guide track. The securing unit 26*a* comprises at least one spring element 52*a*, 54*a*, which acts on at least one of the movably mounted further positive locking and/or non-positive locking elements 30*a*, 32*a* of the securing unit 26*a* with a spring force in the direction of the clamping element 20*a*, 22*a*, in particular of the clamping elements 20*a*, 22*a*. It is preferable for in each case one of two spring elements 52*a*, 54*a* of the securing unit 26*a* to be assigned to in each case one of the further positive locking and/or non-positive locking elements 30*a*, 32*a*. It is conceivable for the securing unit 26*a* to comprise at least one additional spring element (not illustrated in any more detail here) which acts on the movably mounted element 34*a* of the securing unit 26*a* with a spring force in the direction of the transmission element 36*a*. The clamping element 20*a*, 22*a*, in particular the clamping elements 20*a*, 22*a*, comprise(s) at least one securing recess 56*a*, 58*a*, into which the further positive locking and/or non-positive locking element 30*a*, 32*a* at least partially engages in the clamping position of the clamping element 20*a*, 22*a*, in particular of the clamping elements 20*a*, 22*a*.

The positive locking and/or non-positive locking element 30*a*, 32*a*, 34*a*, in particular the further positive locking and/or non-positive locking elements 30*a*, 32*a* and the additional positive locking and/or non-positive locking element 34*a*, are/is movable counter to a spring force of the spring element 52*a*, 54*a* by means of the operator control unit 24*a*. The operator control unit 24*a* may comprise a force conversion element which moves the positive locking and/or non-positive locking element 30*a*, 32*a*, 34*a*, in particular the further positive locking and/or non-positive locking elements 30*a*, 32*a* and the additional positive locking and/or non-positive locking element 34*a*, out of an engagement position in a manner dependent on a movement of the operator control element 76*a* and/or of the actuating element 82*a* in the direction of the clamping unit 16*a*. The operator control unit 24*a* may alternatively have an electronic monitoring unit which monitors a movement of the operator control element 76*a* and/or of the actuating element 82*a*, wherein, in the event of a movement of the operator control element 76*a* and/or of the actuating element 82*a* being detected, the positive locking and/or non-positive locking element 30*a*, 32*a*, 34*a*, in particular the further positive locking and/or non-positive locking elements 30*a*, 32*a* and the element 34*a*, are/is movable out of an engagement position by means of an electric actuator. Further embodiments of the operator control unit 24*a* that appear expedient to a person skilled in the art for a movement of the positive locking and/or non-positive locking element 30*a*, 32*a*, 34*a*, in particular of the further positive locking and/or non-positive locking elements 30*a*, 32*a* and of the additional positive locking and/or non-positive locking element 34*a*, are likewise conceivable.

Figure 3:
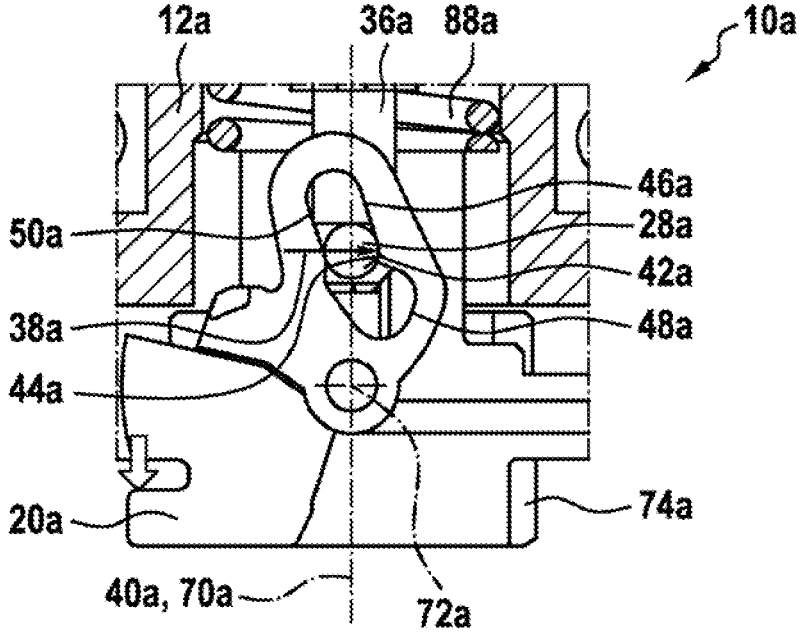
FIG. 3 shows a detail view of a securing unit of the quick clamping device according to the disclosure in a schematic illustration.

The securing unit 26*a* is formed at least partially integrally with the clamping unit 16*a*, wherein the securing unit 26*a* has at least one self-locking contour 42*a* arranged on the clamping element 20*a*, 22*a*. The securing unit 26*a* referee comprises at least two self-locking contours 42*a*, wherein one of the at least two self-locking contours 42*a* is arranged in each case on one of the clamping elements 20*a*, 22*a* (only one of the two self-locking contours 42*a* is illustrated in FIG. 3). The self-locking contour 42*a* is formed integrally with the slotted-guide element 50*a*. In particular, the self-locking contour 42*a* forms an edge of the slotted-guide element 50*a* which delimits the slotted-guide element 50*a*. The slotted-guide element 50*a* is designed preferably as a slotted-guide track, which is provided for moving the clamping element 20*a*, 22*a*, in particular the clamping elements 20*a*, 22*a*, into the clamping position and/or into the release position by means of an interaction with the positive locking and/or non-positive locking element 28*a* designed as slotted-guide engagement element. The self-locking contour 42*a* is arranged in a transition region between a clamping contour 46*a* and a release contour 48*a* of the slotted-guide element 50*a* of the clamping unit 16*a*. The clamping contour 46*a* is provided for moving the clamping element 20*a*, 22*a*, in particular the clamping elements 20*a*, 22*a*, into the clamping position by means of an interaction with the positive locking and/or non-positive locking element 28*a* designed as slotted-guide engagement element. The release contour 48*a* is provided for moving the clamping element 20*a*, 22*a*, in particular the clamping elements 20*a*, 22*a*, into the release position by means of an interaction with the positive locking and/or non-positive locking element 28*a* designed as slotted-guide engagement element.

In a clamping position of the clamping element 20*a*, 22*a*, in particular of the clamping elements 20*a*, 22*a*, the self-locking contour 42*a* is oriented such that, in the event of the clamping element 20*a*, 22*a*, in particular the clamping elements 20*a*, 22*a*, being acted on with a force which is decoupled from the operator control unit 24*a* and which acts in the direction of the release position of the clamping element 20*a*, 22*a*, in particular of the clamping elements 20*a*, 22*a*, a main securing force 38*a* can be exerted on the clamping element 20*a*, 22*a*, in particular on the clamping elements 20*a*, 22*a*, at least by means of the self-locking contour 42*a*, which main securing force runs at least substantially perpendicular to a clamping axis 40*a* of the clamping unit 16*a*. The main securing force 38*a* preferably acts such that no force components or only small force components act along the clamping axis 40*a* on the transmission element 36*a*. It can advantageously be achieved that the slotted-guide engagement element cannot move into a release contour 48*a* of the slotted-guide element 50*a*, in particular of the slotted-guide track. Preferably, by means of the interaction of the self-locking contour 42*a* with the positive locking and/or non-positive locking element 28*a* designed as slotted-guide engagement element, in the event of the clamping element 20*a*, 22*a*, in particular the clamping elements 20*a*, 22*a*, being subjected to a force which is decoupled from the operator control unit 24*a* and which acts in the direction of the release position of the clamping element 20*a*, 22*a*, in particular of the clamping elements 20*a*, 22*a*, a main securing force 38*a* can be exerted on the clamping element 20*a*, 22*a*, in particular on the clamping elements 20*a*, 22*a*. Preferably, by means of an interaction of the self-locking contour 42*a* with the positive locking and/or non-positive locking element 28*a* designed as slotted-guide engagement element, in the event of the clamping element 20*a*, 22*a*, in particular the clamping elements 20*a*, 22*a*, being subjected to a force which is decoupled from the operator control unit 24*a* and which acts in the direction of the release position of the clamping element 20*a*, 22*a*, in particular of the clamping elements 20*a*, 22*a*, a movement capability of the clamping element 20*a*, 22*a*, in particular of the clamping elements 20*a*, 22*a*, into the release position can be substantially blocked. At least in the clamping position of the clamping element 20*a*, 22*a*, in particular of the clamping elements 20*a*, 22*a*, the self-locking contour 42*a* encloses an angle of less than 40° with the clamping axis 40*a* of the clamping unit 16*a*. It is conceivable that, in the clamping position of the clamping element 20*a*, 22*a*, in particular of the clamping elements 20*a*, 22*a*, the self-locking contour 42*a*, in particular a contact surface 44*a* of the self-locking contour 42*a*, is oriented in the direction of the operator control unit 24*a* or in the direction of the clamping element 20*a*, 22*a*, in particular of the clamping elements 20*a*, 22*a*, in particular so as to enclose an angle of less than 40° with the clamping axis 40*a* of the clamping unit 16*a*. The self-locking contour 42*a* has at least the contact surface 44*a*, which in the clamping position of the clamping element 20*a*, 22*a*, in particular of the clamping elements 20*a*, 22*a*, runs at least substantially parallel to the clamping axis 40*a* of the clamping unit 16*a*. By means of an interaction of the contact surface 44*a* of the self-locking contour 42*a* and the positive locking and/or non-positive locking element 28*a* designed as slotted-guide engagement element, in the event of the clamping element 20*a*, 22*a*, in particular the clamping elements 20*a*, 22*a*, being subjected to a force which is decoupled from the operator control unit 24*a* and which acts in the direction of the release position of the clamping element 20*a*, 22*a*, in particular of the clamping elements 20*a*, 22*a*, a main securing force 38*a* can be exerted on the clamping element 20*a*, 22*a*, in particular on the clamping elements 20*a*, 22*a*. It is advantageously possible to realize a self-locking function of the clamping unit 16*a* and/or of the securing unit 26*a*, in order the clamping element 20*a*, 22*a*, in particular the clamping elements 20*a*, 22*a*, in the event of the clamping element 20*a*, 22*a*, in particular the clamping elements 20*a*, 22*a*, being subjected to a force which is decoupled from the operator control unit 24*a* and which acts in the direction of the release position of the clamping element 20*a*, 22*a*, in particular of the clamping elements 20*a*, 22*a*, to ensure a movement of the clamping element 20*a*, 22*a*, in particular of the clamping elements 20*a*, 22*a*, from the clamping position into the release position of the clamping element 20*a*, 22*a*, in particular of the clamping elements 20*a*, 22*a*.

The securing unit 26*a* has at least one output element 60*a* which is provided for outputting at least a functional state of the securing unit 26*a* to an operator. The output element 60*a* may be designed as a mechanical element, as an electronic element or as an electrical element. The output element 60*a* is preferably provided for outputting a functional state of the securing unit 26*a* by haptic, acoustic and/or optical means. The functional state of the securing unit 26*a* preferably describes a state of the securing unit 26*a* such as for example a securing of the clamping element 20*a*, 22*a*, a released state of the securing unit 26*a*, in which the clamping element 20*a*, 22*a* is not secured, a defect of the securing unit 26*a* or other states of the securing unit 26*a* that appear expedient to a person skilled in the art. The output element 60*a* may be designed as a display, as a single light source, such as for example an LED, as a mechanically movable display element, as a loudspeaker or the like.

Figure 4:
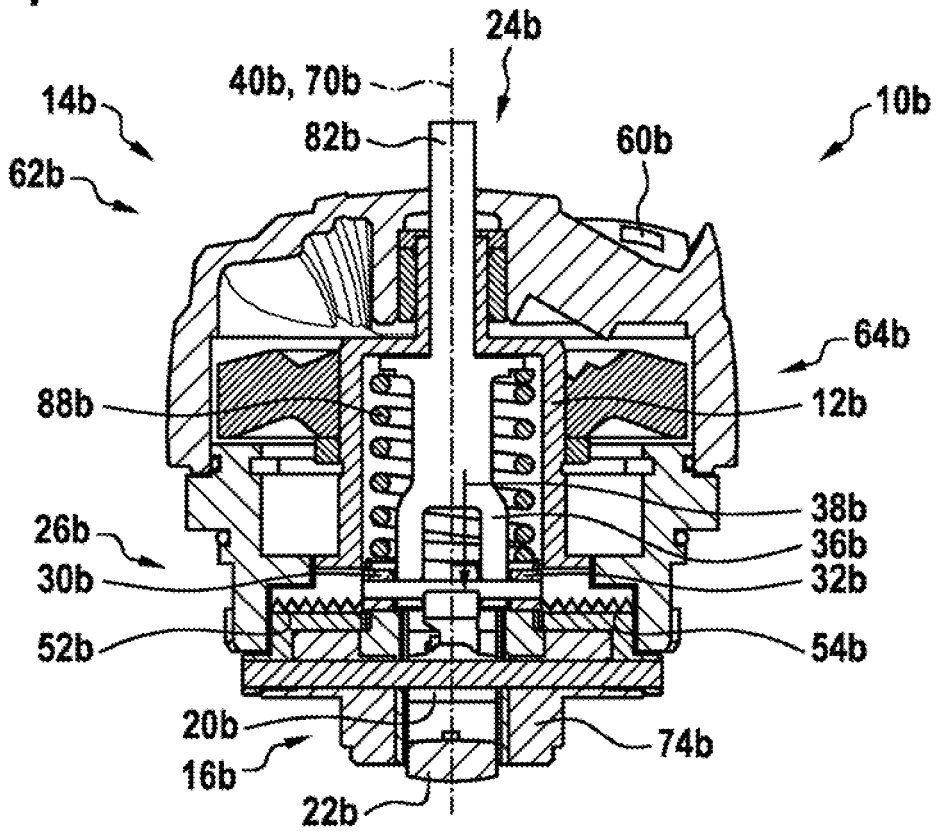
FIG. 4 shows a sectional view of an alternative portable power tool according to the disclosure and of an alternative quick clamping device according to the disclosure having an alternative securing unit in a schematic illustration.

FIG. 4 shows a further exemplary embodiment of the disclosure. The following descriptions and the drawings are restricted substantially to the differences between the exemplary embodiments, wherein, with regard to components of identical designation, in particular with regard to components with the same reference designations, reference may basically also be made to the drawings and/or the description of the other exemplary embodiments, in particular of FIGS. 1 to 3. To distinguish between the exemplary embodiments, the alphabetic character a has been added as a suffix to the reference designations of the exemplary embodiment in FIGS. 1 to 3. In the exemplary embodiments of FIG. 4, the alphabetic character a has been replaced by the alphabetic character b.

FIG. 4 shows a sectional view of an alternative portable power tool 14*b* and of an alternative quick clamping device 10*b*. The portable power tool 14*b* illustrated in FIG. 4 has an at least substantially analogous design in relation to the portable power tool 14*a* described in the description relating to FIGS. 1 to 3. The quick clamping device 10*b* for the portable power tool 14*b*, which has at least the output shaft 12*b* that can be driven in rotation, comprises at least one clamping unit 16*b*, which, for tool-free fixing of an insert tool unit (not illustrated in any more detail here) to the output shaft 12*b*, has at least one movably mounted clamping element 20*b*, 22*b*, in particular at least two movably mounted clamping elements 20*b*, 22*b*, for the action of a clamping force on the insert tool unit in a clamping position of the clamping element 20*b*, 22*b*.

Furthermore, the quick clamping device 10*b* comprises at least one operator control unit 24*b* for moving the clamping element 20*b*, 22*b* into the clamping position and/or into a release position of the clamping element 20*b*, 22*b*, in which the insert tool unit 18*b* is removable from the clamping unit 16*b* and/or from the output shaft 12*b*. The operator control unit 24*b* comprises at least one movably mounted operator control element (not illustrated in any more detail here) which is provided for acting on an actuating element 82*b* of the operator control unit 24*b* in order to move the clamping element 20*b*, 22*b* into the clamping position and/or into a release position. The actuating element 82*b* is connected rotationally conjointly to the output shaft 12*b* and is mounted so as to be movable in translational fashion in the output shaft 12*b*. It is however also conceivable for the actuating element 82*b* and/or the operator control unit 24*b* to be designed analogously to the actuating element 82*a* illustrated in FIGS. 1 to 3 and/or to the operator control unit 24*a* illustrated in FIGS. 1 to 3.

Furthermore, the quick clamping device 10*b* comprises at least one securing unit 26*b*, in particular a self-locking unit and/or a detent unit, which is provided for preventing a movement of the clamping element 20*b*, 22*b* from the clamping position into the release position of the clamping element 20*b*, 22*b* at least in the event of the clamping element 20*b*, 22*b* being subjected to a force which is decoupled from the operator control unit 24*b* and which acts in the direction of the release position of the clamping element 20*b*, 22*b*. The securing unit 26*b* has, in particular in addition to a self-locking contour (not illustrated in any more detail here), at least one positive locking and/or non-positive locking element 28*b*, 30*b* which, by means of a centrifugal force, in particular by means of a centrifugal force that can be caused owing to a rotation of the securing unit 26*b* and/or of the output shaft 12*b* about an axis of rotation 70*b* of the output shaft 12*b*, is movable into a securing position of the positive locking and/or non-positive locking element 28*b*, 30*b*, in which the clamping element 20*b*, 22*b* is substantially secured against a movement from the clamping position into the release position of the clamping element 20*b*, 22*b*. The securing unit 26*b* preferably comprises at least two positive locking and/or non-positive locking elements 28*b*, 30*b* which, by means of a centrifugal force, are movable into a securing position of the positive locking and/or non-positive locking elements 28*b*, 30*b*, in which the clamping element 20*b*, 22*b* is substantially secured against a movement from the clamping position into the release position of the clamping element 20*b*, 22*b*. The positive locking and/or non-positive locking elements 28*b*, 30*b* are mounted so as to be movable, in particular movable in translational fashion, along a direction running at least substantially perpendicular to the axis of rotation 70*b* of the output shaft 12*b*. The securing unit 26*b* comprises at least one spring element 52*b*, 54*b* which acts on at least one of the movably mounted positive locking and/or non-positive locking elements 28*b*, 30*b* of the securing unit 26*b* with a spring force in the direction of the clamping elements 20*b*, 22*b*. The securing unit 26*b* preferably comprises at least two spring elements 52*b*, 54*b*, wherein in each case one of the at least two spring elements 52*b*, 54*b* acts on in each case one of the positive locking and/or non-positive locking elements 28*b*, 30*b* with a spring force. The positive locking and/or non-positive locking elements 28*b*, 30*b* can be moved into a securing position counter to a spring force of the spring elements 52*b*, 54*b* by a centrifugal force. With regard to further features of the quick clamping device 10*b* illustrated in FIG. 4, reference may be made to the description of the quick clamping device 10*a* illustrated in FIGS. 1 to 3.

The invention claimed is:

1. A quick clamping device for a portable power tool, comprising:

a housing;

at least one output shaft configured to be driven in rotation;

at least one clamping unit including at least one movably mounted clamping element located at least partially outside of the housing and configured to exert a clamping force on an insert tool unit in a clamping position of the at least one movably mounted clamping element, the at least one clamping unit configured for fixing the insert tool unit to the at least one output shaft without use of tools;

at least one operator control unit configured to move the at least one movably mounted clamping element into the clamping position and/or to move the at least one movably mounted clamping element into a release position of the at least one movably mounted clamping element; and at least one securing unit configured to prevent movement of the at least one movably mounted clamping element from the clamping position into the release position of the at least one movably mounted clamping element at least when the at least one movably mounted clamping element is acted on by a first force which is decoupled from the at least one operator control unit and which acts in a first direction toward the release position of the at least one movably mounted clamping element, wherein, in the release position, the insert tool unit is configured to be removed from the at least one clamping unit and/or from the at least one output shaft, and wherein the at least one movably mounted clamping element has a pivot axis that runs at least substantially perpendicular to an axis of rotation of the output shaft.

2. The quick clamping device as claimed in claim 1, wherein:

the at least one securing unit includes at least one movably mounted positive locking and/or non-positive locking element; and at least in the clamping position of the at least one movably mounted clamping element, the at least one movably mounted positive locking and/or non-positive locking element engages at least partially into at least one of the at least one movably mounted clamping element and a transmission element, which interacts with the clamping element in order to secure the at least one movably mounted clamping element against movement into the release position of the at least one movably mounted clamping element.

3. The quick clamping device as claimed in claim 1, wherein:

the at least one securing unit includes at least one movably mounted positive locking and/or non-positive locking element;

at least in the clamping position of the at least one movably mounted clamping element, the at least one movably mounted positive locking and/or non-positive locking element bears against the at least one movably mounted clamping element in such a way that the at least one movably mounted positive locking and/or non-positive locking element exerts a main securing force on the at least one movably mounted clamping element along a second direction running at least substantially parallel or at least substantially perpendicular to a clamping axis of the at least one clamping unit; and the main securing force counteracts movement of the at least one movably mounted clamping element into the release position.

4. The quick clamping device as claimed in claim 1, wherein:

the at least one securing unit is at least partially integral with the at least one clamping unit; and the at least one securing unit includes at least one self-locking contour arranged on the at least one movably mounted clamping element.

5. The quick clamping device as claimed in claim 4, wherein:

in the clamping position of the at least one movably mounted clamping element, the self-locking contour is oriented such that when the at least one movably mounted clamping element is subjected to the first force which is decoupled from the at least one operator control unit and which acts in the first direction of the release position of the at least one movably mounted clamping element, a main securing force running at least substantially perpendicular to the clamping axis of the at least one clamping unit is exerted on the at least one movably mounted clamping element at least via the at least one self-locking contour.

6. The quick clamping device as claimed in claim 4, wherein, at least in the clamping position of the at least one movably mounted clamping element, the at least one self-locking contour encloses an angle of less than 40° relative to the clamping axis of the at least one clamping unit.

7. The quick clamping device as claimed in claim 4, wherein:

the at least one self-locking contour includes at least one contact surface; and in the clamping position of the at least one movably mounted clamping element, the at least one contact surface runs at least substantially parallel to the clamping axis of the at least one clamping unit.

8. The quick clamping device as claimed in claim 4, wherein:

the at least one clamping unit includes a slotted-guide element having a clamping contour and a release contour; and the at least one self-locking contour is arranged in a transition region between the clamping contour and the release contour.

9. The quick clamping device as claimed in claim 1, wherein:

the at least one securing unit includes at least one spring element and at least one movably mounted positive locking and/or non-positive locking element; and the at least one spring element acts on the at least one movably mounted positive locking and/or non-positive locking element with a spring force in a direction of the at least one movably mounted clamping element.

10. The quick clamping device as claimed in claim 9, wherein the at least one movably mounted positive locking and/or non-positive locking element is movable counter to the spring force of the at least one spring element via the at least one operator control unit.

11. The quick clamping device as claimed in claim 9, wherein:

the at least one movably mounted clamping element includes at least one securing recess; and in the clamping position of the at least one movably mounted clamping element, the at least one movably mounted positive locking and/or non-positive locking element at least partially engages into the at least one securing recess.

12. The quick clamping device as claimed in claim 1, wherein:

the at least one securing unit includes at least one positive locking and/or non-positive locking element movable away from a rotation axis of the at least one output shaft via rotation of the at least one output shaft into a securing position of the at least one positive locking and/or non-positive locking element; and in the securing position, the at least one movably mounted clamping element is substantially secured against movement from the clamping position into the release position of the at least one movably mounted clamping element.

13. The quick clamping device as claimed in claim 1, wherein the at least one securing unit includes at least one output element configured to output at least a functional state of the at least one securing unit to an operator.

14. The quick clamping device of claim 1, wherein the portable power tool is an angle grinder.

15. The quick clamping device of claim 1, wherein the at least one securing unit is at least one of a self-locking unit and a detent unit.

16. A portable power tool, comprising:

a housing a quick clamping device including:

at least one output shaft configured to be driven in rotation;

at least one clamping unit including at least one movably mounted clamping element located at least partially outside of the housing and configured to exert a clamping force on an insert tool unit in a clamping position of the at least one movably mounted clamping element, the at least one clamping unit configured to fix the insert tool unit to the at least one output shaft without use of tools;

at least one operator control unit configured to move the at least one movably mounted clamping element into the clamping position and/or to move the at least one movably mounted clamping element into a release position of the at least one movably mounted clamping element; and at least one securing unit configured to prevent movement of the at least one movably mounted clamping element from the clamping position into the release position of the at least one movably mounted clamping element at least when the at least one movably mounted clamping element is acted on by a first force which is decoupled from the at least one operator control unit and which acts in a first direction toward the release position of the at least one movably mounted clamping element, wherein, in the release position, the insert tool unit is configured to be removed from the at least one clamping unit and/or from the at least one output shaft, and wherein the at least one movably mounted clamping element has a pivot axis that runs at least substantially perpendicular to an axis of rotation of the output shaft.

17. The quick clamping device of claim 16, wherein the portable power tool is an angle grinder.

* * * * *